United States Patent [19]

Choung

[11] Patent Number: 4,491,358

[45] Date of Patent: Jan. 1, 1985

[54] CLAMP

[75] Inventor: Moon Choung, Bayside, N.Y.

[73] Assignee: Edison International, Inc., Rolling Meadows, Ill.

[21] Appl. No.: 370,299

[22] Filed: Apr. 21, 1982

[51] Int. Cl.[3] ..... B66C 1/44

[52] U.S. Cl. ..... 294/101

[58] Field of Search ..... 294/101, 104, 103 R, 294/DIG. 1, DIG. 2, 78; 24/243 B, 263 A, 248 C, 243 CC, 263 PC

[56] References Cited

U.S. PATENT DOCUMENTS

| | | | |
|---|---|---|---|
| 2,649,123 | 8/1953 | Gulland | 144/304 |
| 2,916,321 | 12/1959 | Renfroe et al. | 294/101 |
| 3,034,971 | 7/1977 | Tsuyama | 269/249 |
| 3,120,046 | 2/1964 | Olson | 24/248 |
| 3,258,821 | 7/1966 | Curran | 24/243 |
| 3,269,766 | 8/1966 | Gardner | 294/101 |
| 3,851,358 | 12/1974 | Janosko | 294/104 |
| 3,947,011 | 3/1976 | Tsuyama | 269/249 |
| 4,183,571 | 1/1980 | Renfroe | 294/101 |

FOREIGN PATENT DOCUMENTS

| | | |
|---|---|---|
| 1203108 | 1/1960 | France . |
| 594011 | 1/1978 | U.S.S.R. . |
| 779265 | 11/1980 | U.S.S.R. . |

OTHER PUBLICATIONS

Cataloge pp. of J. C. Renfroe & Sons, Jacksonville, FL.

*Primary Examiner*—James B. Marbert

*Attorney, Agent, or Firm*—Jon Carl Gealow; Hugh M. Gilroy

[57] ABSTRACT

A clamp suitable for a wide variety of uses is provided. The clamp is particularly suitable for selectively either rotating a variety of standard structural workpieces so that they rest on a new base after a lift, or lifting workpieces so that they rest on their original base after a lift. The invention includes a swivel pad having at least two faces and a settable jaw for retaining workpieces. A selection of one face to engage a workpiece will cause it to rest on a new base after a lift, and the selection of another will cause the workpiece to rest on its original base after a lift.

9 Claims, 10 Drawing Figures

FIG. 4
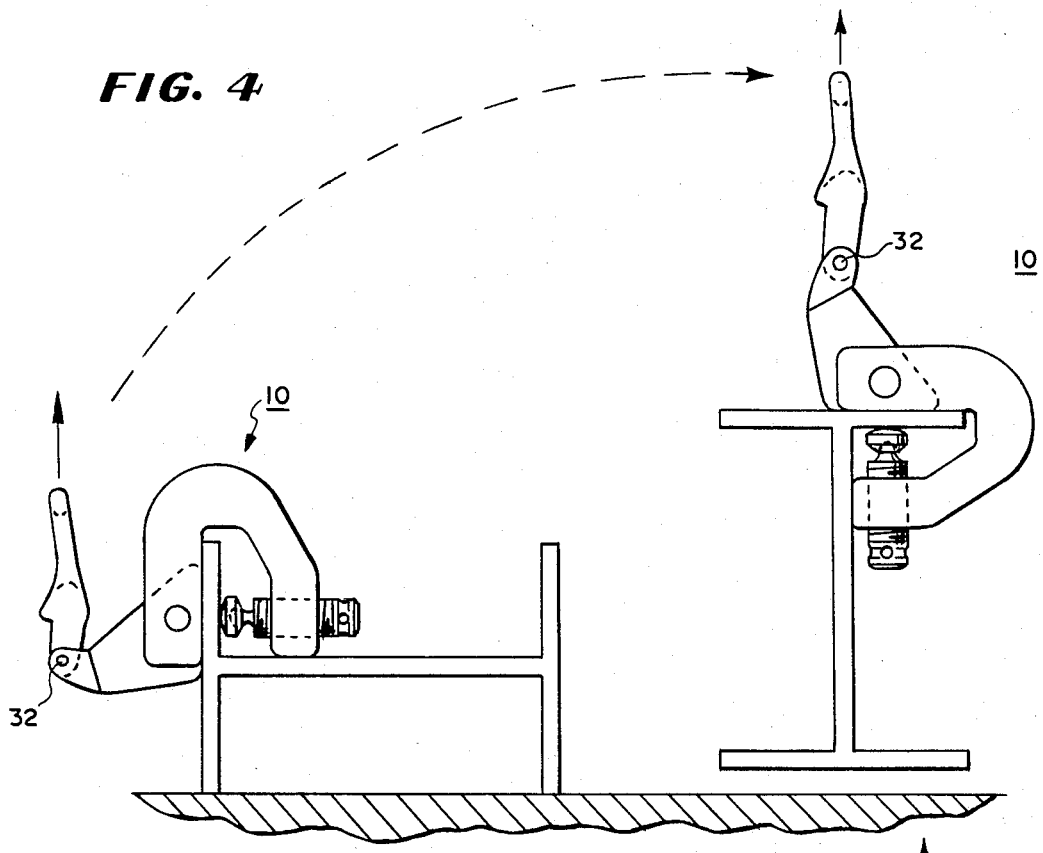
FIG. 5
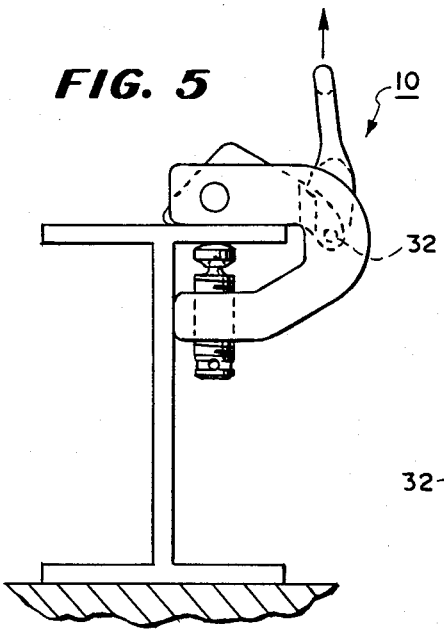
FIG. 6
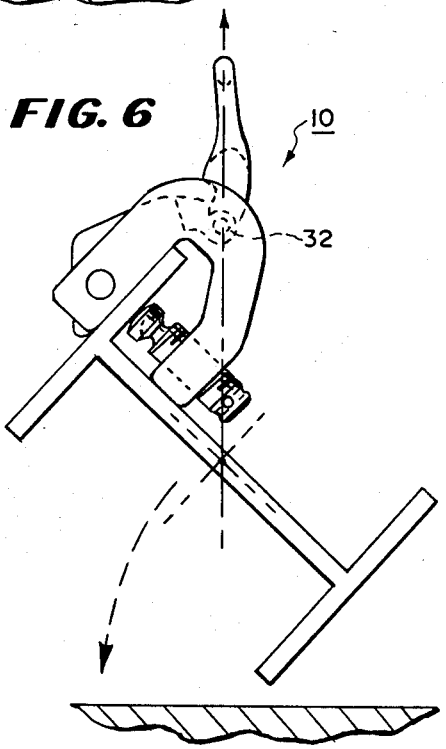
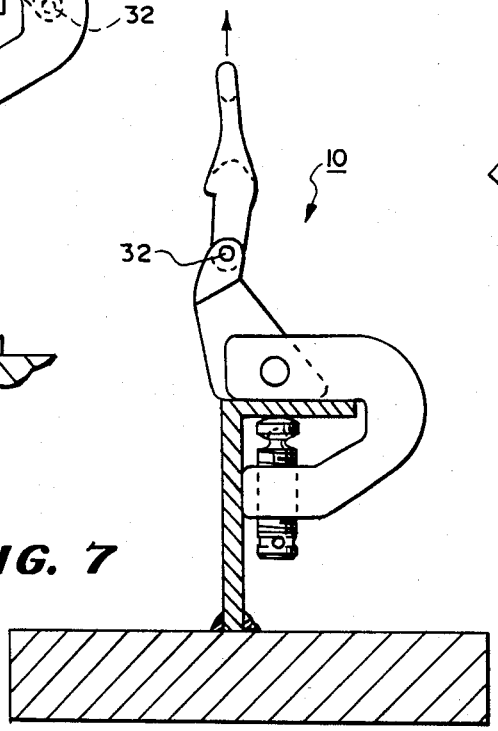
FIG. 7

CLAMP

BACKGROUND OF THE INVENTION

This invention relates generally to clamps used for lifting and maneuvering a variety of standard structural workpieces. It is particularly suitable for selectively either turning a workpiece so that it rests on a new base after being lifted, or lifting a workpiece so that it rests on its original base after a lift. The clamp may also be used for lifting a plate and as a portable hanger.

Clamps which securely grip workpieces and which could be used as portable hangers exist in the prior art. An example of a clamp which securely grips workpieces, particularly plates, is that disclosed by U.S. Pat. No. 3,269,766. This prior art clamp includes a settable jaw having a convex cam to retain the workpiece. The convex cam is connected by an articulation to the end of a screw threaded through an arm of the clamp. Workpieces are retained between the convex cam and a second arm of the clamp. The clamp disclosed in U.S. Pat. No. 3,269,766 will not selectively turn the workpiece.

Clamps which selectively turn workpieces also exist in the prior art. They are used to rotate the workpiece from its freestanding original orientation, when it was unsupported by a clamp, through ninety degrees to rest on a new base. However, at least one of these clamps is not recommended for lifting plate, and it does not lock or secure the workpiece within the clamp unless a hoisting force is applied.

Standard structural workpieces exist in a wide variety of shapes such as flanged beams, angles, plates, channels and tubes. Each are encountered in various sizes, and composite structural elements may be fabricated from them, such as girders and angle beams. Structural shaped workpieces and composite structural elements must be maneuvered into position to facilitate their assembly in structures.

Typically a number of single purpose clamps are used to accomplish various maneuvers and purposes. Prior art clamps exist for maintaining flanged beams and girders in a balanced horizontal position. Others exist for vertical lifting of plate and of other structural shapes having vertical portions when freestanding. Some exist for horizontal lifts of plate and the like, but they must be used in pairs and are non-locking.

Multipurpose clamps are also used to accomplish various purposes. Locking clamps capable of horizontal lifts in pairs and intermittent vertical lifts are known. Also known are clamps which slide over a beam's horizontal flange for lifting, and can additionally be used as portable hangers.

No one of the prior art clamps is capable of satisfying all of the foregoing functions while positively locking the workpiece and yet be particularly suitable for selectively turning a variety of workpieces.

SUMMARY OF THE INVENTION

This invention provides a single compact locking clamp which is capable of satisfying a wide diversity of requirements often satisfied by a number of single purpose clamps. The clamp includes a swivel pad, pivotally mounted to a slotted rigid body, which receives a longitudinal portion of a workpiece in its slot. The swivel pad has at least two faces for selectively engaging the workpiece. Each face may be swiveled into position to engage and retain the workpiece between the face and a locking or settable jaw. The faces which selectively engage the workpiece do so in planes which intersect. Pivotally mounted to the swivel pad is a shackle for attaching the clamp to a lifting means such as a mechanical hoist. When the workpiece is suspended from the clamp, a vertical plane through the center of gravity of the workpiece will contain the shackle pivot axis of a shackle pivot means. If the shackle pivot axis is not initially contained within a vertical plane through the freestanding workpiece, then the clamp and workpiece rotate about the shackle pivot axis until alignment occurs. In most instances the weight of the workpiece so greatly exceeds the weight of the clamp, that any misalignment of the axis and the plane is insignificant. The amount of rotation which occurs when the workpiece is suspended from the clamp is proportional to the initial distance between the shackle pivotal axis and a vertical plane through the center of gravity of the freestanding workpiece.

Generally if little rotation occurs during a lift, the workpiece will not be turned after the lift. If the freestanding workpiece is resting on a stable base, and if a plane through the center of gravity of the workpiece and the shackle pivot axis passes through that base, then the workpiece will rest on that original base after a lift. When this plane is not vertical, some workpiece rotation will occur once the workpiece is suspended. However as the workpiece is lowered to rest, the workpiece will counter-rotate to rest on its original base and return to its original orientation.

In contrast, when considerable rotation occurs during a lift, the workpiece will be turned to rest on a new base after a lift. If a plane through the center of gravity of the freestanding workpiece and the shackle pivot axis does not pass through the base, then the workpiece will rest on a new base after a lift. As the workpiece is lifted it will rotate to bring the plane between the shackle pivot axis and the center of gravity into a vertical orientation. This rotation is so great that the workpiece cannot counter rotate as it is lowered and the workpiece will rest on a new base after a lift.

No rotation of the workpiece occurs when the plane through the shackle pivot axis and the freestanding workpiece's center of gravity is vertical. When the plane through the shackle pivot axis and the center of gravity of the freestanding workpiece is horizontal, the workpiece will be rotated by ninety degrees during and after a lift. Each of these situations may be desirable to facilitate assembly of structural workpieces.

When there are only two faces for engaging the workpiece, the swivel pad of the preferred embodiment of the clamp approximates a right triangle and the shackle pivot axis is located near the apex. The faces engage the workpiece in planes which intersect. The angular relationship between each of the planes and the shackle pivotal axis is arranged so that the selection of one face will cause of the workpiece to rest on a new base after a lift, and the selection of the other face will cause the workpiece to return to its original base. In light of the triangular shape of the swivel pad, one of the faces is called a base face and the other a hypotenusal face for convenience of nomenclature.

A less compact clamp for selective turning could have a swivel pad of a non-triangular shape with only two engaging faces, but the angular relationship among the planes of engagement of the faces and the shackle pivot axis would exist. The relationship is such, that in the preferred embodiment, a selection of the base face to engage a flange of a flanged beam will generally align the shackle pivotal axis in, or near, a horizontal or vertical plane containing the center of gravity of a range of sizes of flanged beams. Similarly the selection of the hypotenusal face will generally align the shackle pivot axis on or near a horizontal or vertical plane containing the center of gravity of plate. The relationship insures that for a wide range of flanged beams, at rest on a larger surface of a flange, the selection of a hypotenusal face to engage the upper flange will position the shackle pivot axis so that a plane passing through it and the center of gravity of the beam will not pass through a flange surface. Within these constraints the clamp in its preferred embodiment nearly minimizes the distances between the pivotal mounting of the swivel pad, and both the shackle pivot axis and the engaging surfaces so as to provide for compactness of the clamp.

In this manner a compact locking clamp suitable for a wide variety of uses, particularly selectively turning workpieces, is provided.

BRIEF DESCRIPTION OF THE DRAWING

FIG. 4 illustrates the rotation of a flanged beam wherein the web is rotated from an initial horizontal orientation to a final vertical orientation.

FIGS. 5 and 6 illustrate the partial rotation of a flanged beam wherein the web is rotated from an initial vertical orientation to an intermediate degree of rotation slightly in excess of forty-five degrees.

FIG. 7 illustrates a lifting operation which will preserve the orientation of the workpiece.

DETAILED DESCRIPTION OF THE PREFERRED EMBODIMENT

Figure 1:
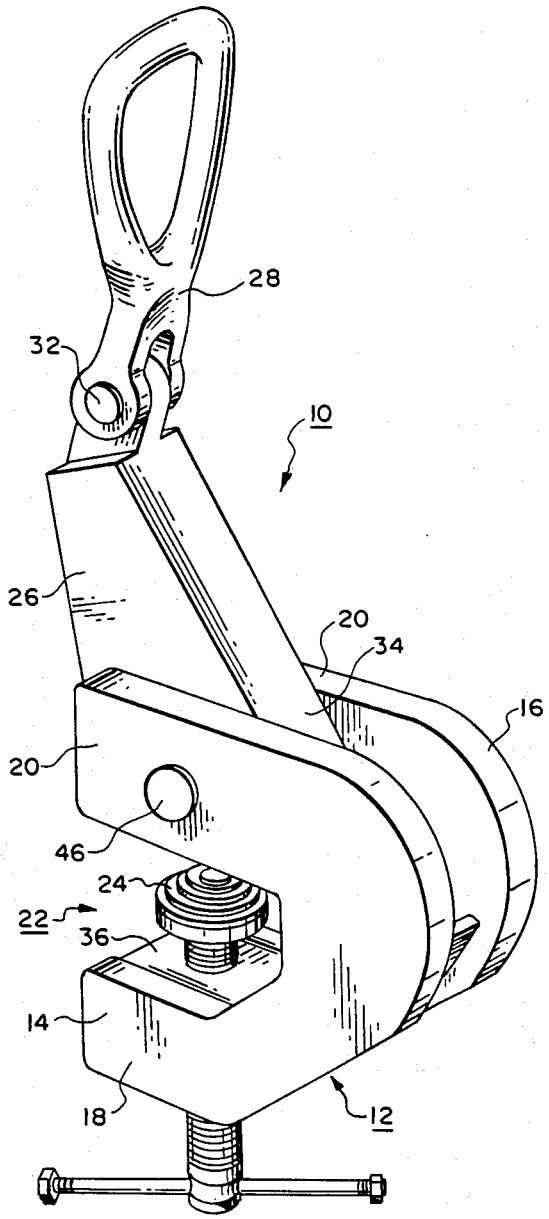
FIG. 1 is a perspective view of a clamp constructed in accordance with the present invention.
Figure 2:
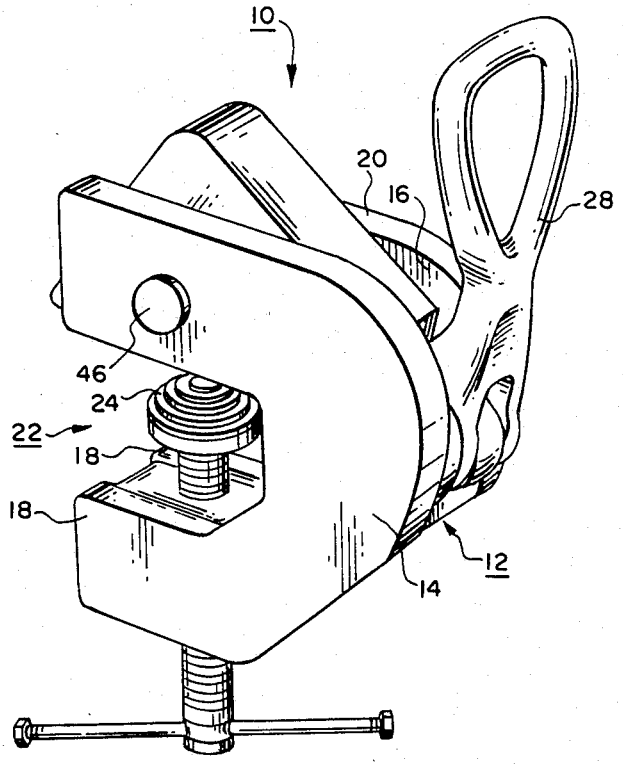
FIG. 2 is a perspective view of the clamp illustrated in FIG. 1 showing the selection of an alternate engaging face.
Figure 3:
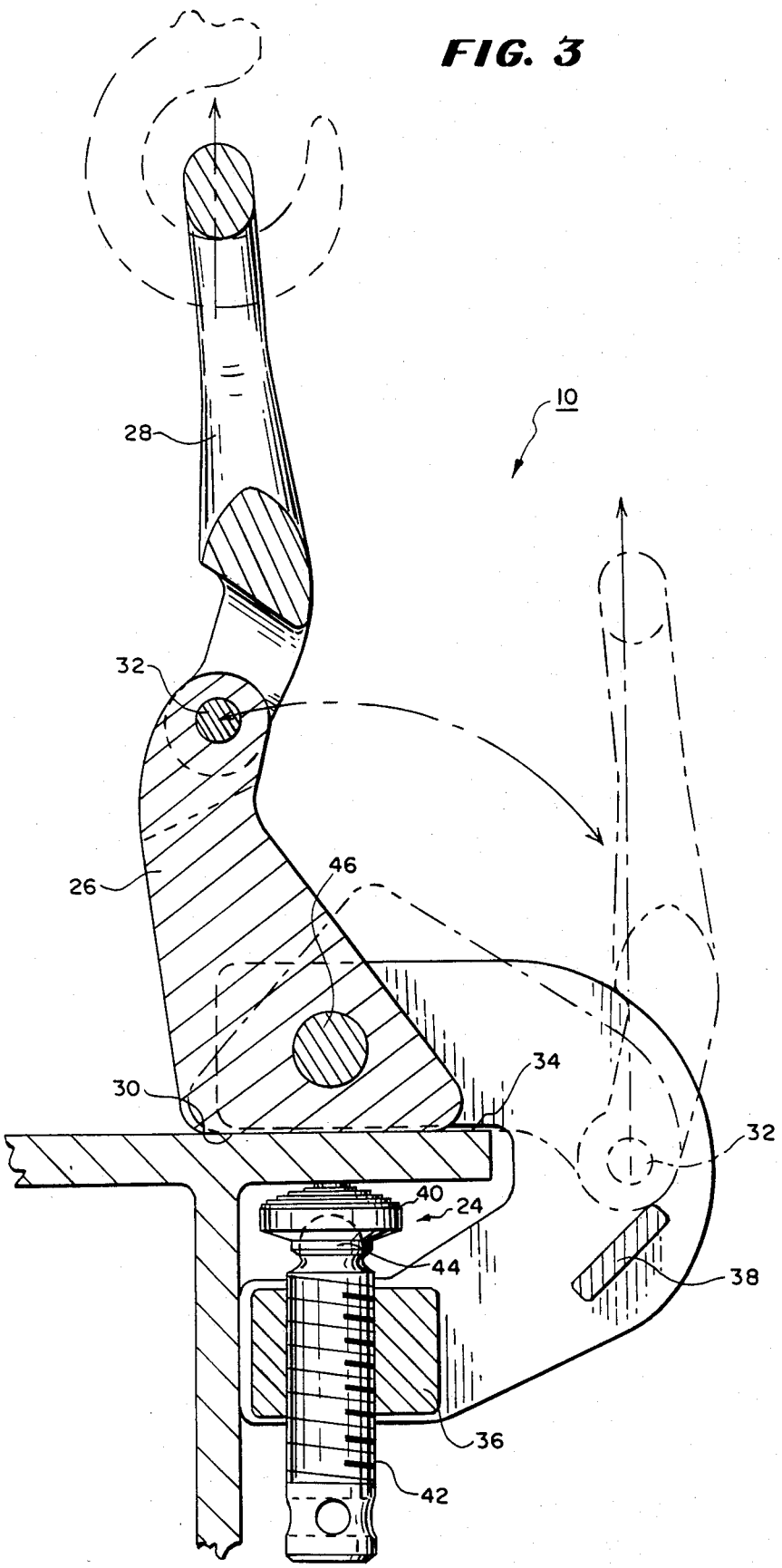
FIG. 3 is a side cross sectional view of the clamp illustrated in FIG. 1 containing a phantom view illustrating the selection of an alternate engaging face as illustrated in FIG. 2.

A clamp 10 constructed in accordance with the present invention is depicted in FIG. 1. Clamp 10 includes a rigid body 12 formed from a first plate 14 and a second plate 16. First and second plates 14 and 16 each have a first arm 18 and a second arm 20 which define a slot 22 between them. Fastened to first arms 18 is a settable jaw 24 which extends into slot 22. Facing settable jaw 24 is a swivel pad 26 pivotally mounted between second arms 20. A shackle 28 is pivotally mounted to swivel pad 26 to provide an attachment to a hoist hook as shown in FIG. 3. Shackle 28 is readily modifiable to provide for other types of hoist attachments.

As most clearly shown in FIG. 3, swivel pad 26 has two faces for selectively engaging a workpiece. A base face 30 positions a shackle pivot axis 32 to one side of settable jaw 24 slightly outboard of first arms 18. A hypotenusal face 34 positions the shackle pivot axis 32 to the opposite side of settable jaw 24 considerably inboard of first arms 18 and between first plate 14 and second plate 16.

Base face 30 can be selected to move the workpiece with or without turning it. The use of base face 30 to move workpieces without turning them is illustrated in FIGS. 3 and 7. In FIGS. 3 and 7 base face 30 positions shackle pivot axis 32 in a vertical plane extending through the freestanding workpiece's center of gravity. All that is required to prevent turning of the workpiece, as a result of a lifting operation, is that the initial position of the shackle pivot axis 32 be near the vertical plane extending through the freestanding workpiece's center of gravity. Any rotation, which does occur when the workpiece is suspended, will be insufficient to present a new stable base to the ground. Nor will sufficient rotation occur to allow the outer edge of the original base to be far enough from the vertical plane extending through the suspended workpiece's center of gravity, to cause further rotation of the workpiece when it is lowered to the ground.

The use of base face 30 to turn a workpiece is shown in FIG. 4. The initial location of shackle pivot axis 32 is in a horizontal plane through the freestanding workpiece's center of gravity. As a result, when the workpiece is lowered, it presents a new stable base to the ground. The length of first arms 18 is selected to position shackle pivot axis 32 in line with the web of various sizes of flanged beams when the base face 30 engages the flange and first arms 18 contacts the web.

It should be noted that base face 30 can also be used to preserve a flanged beam's freestanding orientation when the flanges are initially vertical. For example, if clamp 10 in FIG. 4 were rotated one hundred and eighty degrees, so that the shackle pivot axis 32 were near the vertical plane of the freestanding workpiece's center of gravity, the workpiece would not be turned after a lift. Structural channel can also be lifted in this manner to avoid turning it.

Figure 9:
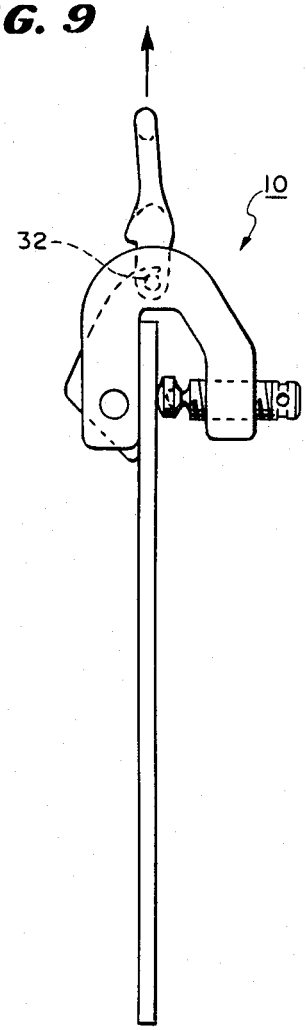
FIG. 9 illustrates the use of the clamp of the present invention to lift a plate while maintaining its vertical orientation.

Similar considerations are involved when using the hypotenusal face 34 to turn a workpiece or preserve its orientation. The use of hypotenusal face 34 to turn a flanged beam, the web of which is initially vertical, is partially illustrated in FIGS. 5 and 6. When a workpiece having the orientation shown in FIG. 6 is lowered, the outer edge of the original base will contact the ground first. As the workpiece is further lowered, it will rotate further to complete the turn and therefore orient the web horizontally. FIG. 9 illustrates the use of hypotenusal face 34 to preserve the vertical orientation of a plate.

Figure 10:
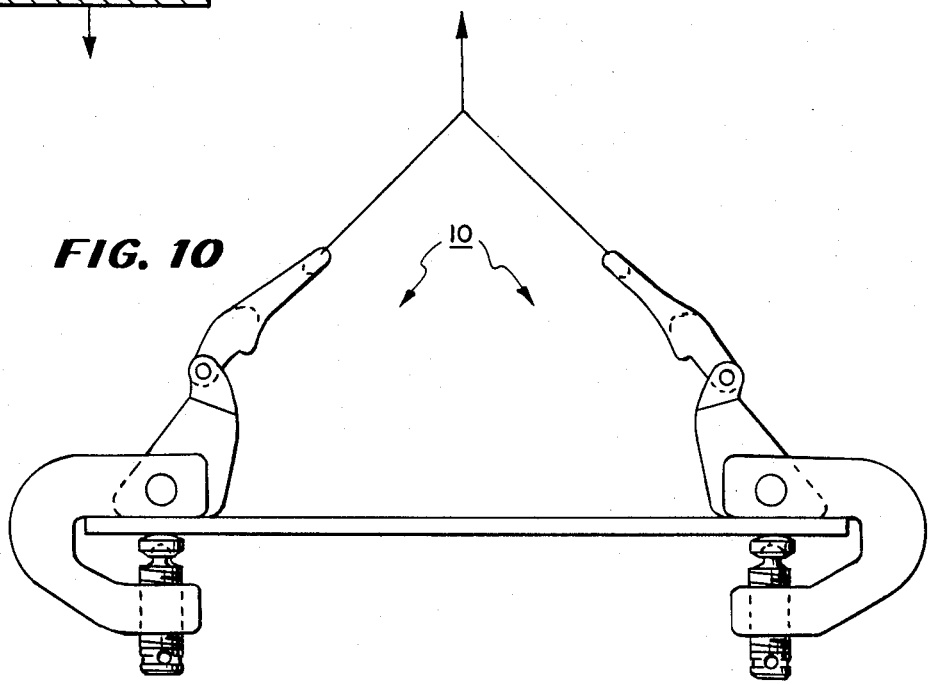
FIG. 10 shows the use of two clamps of the present invention to lift a plate while preserving its horizontal orientation.

When the horizontal orientation of a plate should be preserved, clamp 10 may be used in pairs as shown in FIG. 10. A tube may be similarly lifted.

Figure 8:
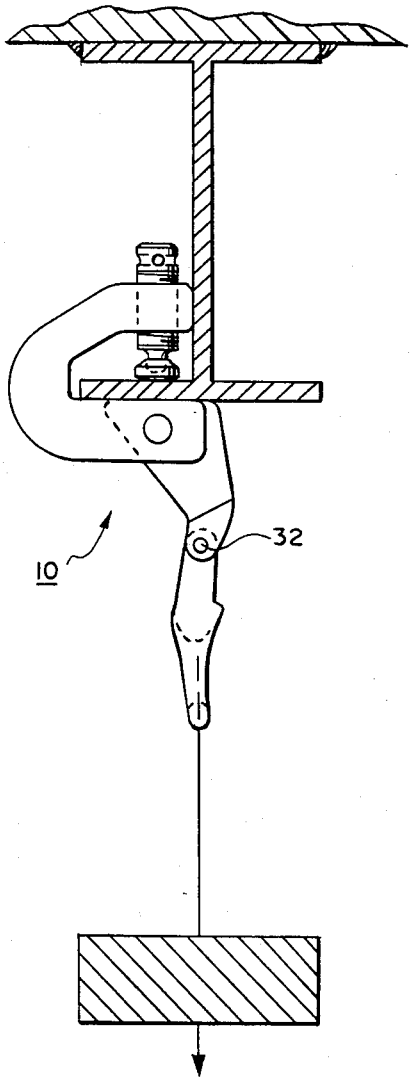
FIG. 8 illustrates the use of the clamp of the present invention as a portable hanger.

Clamp 10 may also be used as a portable hanger as is shown in FIG. 8.

A user of clamp 10 first selects the appropriate face on swivel pad 26 to turn the workpiece or preserve its orientation as desired. Settable jaw 24 is next adjusted and set to firmly engage the workpiece. In the preferred embodiment, settable jaw 24 is of a similar construction to that disclosed in U.S. Pat. No. 3,269,766 to Gardner. It provides two components of force which tend to retain a workpiece.

Securely fastened between the first arms 18 of first and second plates 14 and 16 is a screw block 36. Screw block 36 promotes the rigidity of clamp 10, spaces first plate 14 from second plate 16 and provides a secure fastening for settable jaw 24. Rigidity of clamp 10 is further promoted by spacer 38. The spacer 38 may advantageously be located at the distal ends of second arms 20 if second arms 20 are lengthened to extend beyond swivel pad 26.

The extension of settable jaw 24 is adjustable to accommodate the varying thicknesses of different workpieces. The extension of settable jaw 24 is adjusted by turning a screw 42 in a threaded hole in screw block 36. Before lifting a workpiece, a cam 40 is tightened into firm engagement with the workpiece. A ball and socket articulation 44 connects cam 40 to screw 42, and allows cam 40 to roll on the surface of the workpiece when the workpiece is slightly displaced. The rolling of cam 40 further extends settable jaw 24 towards the engaging face of swivel pad 26 increasing the force retaining the workpiece in clamp 10. For ease of manufacturing, the engaging faces of swivel pad 26 are located so they extend slightly beyond second arms 20 toward cam 40.

The force which retains the workpiece within clamp 10 is variable as a workpiece is moved between different positions. This retaining force results from three identifiable components: screw force caused by tightening settable jaw 24 against the workpiece, roll force caused by displacement of the workpiece which causes cam 40 to roll on the workpiece and increases the extension of settable jaw 24 into slot 22, and a maneuvering force caused by applying a hoisting force to swivel pad 26. The application of the hoisting force at shackle pivot axis 32 tends to cause swivel pad 26 to rotate on swivel pivot means about swivel pad axis 46. As in a lever the unequal distances between shackle pivot axis 32 and swivel pad axis 46 and between swivel pad axis 46 and the line of engagement of the face, results in a increase of the retaining force.

The geometry of swivel pad 26 gradually evolved through a succession of designs to minimize the weight of clamp 10. The angle between the engaging planar surfaces of base face 30 and hypotenusal face 34 is approximately sixty degrees. Swivel pad axis 46 is located near the line bisecting the angle of intersection of the planes of the engaging surfaces. A line between shackle pivot axis 32 and swivel pad axis 46 intersects the base face plane at an angle of about seventy-five degrees. In a clamp 10 rated at three tons, swivel pad axis 46 is approximately 3 inches (7.6 cm) from the point where the planes intersect. Shackle pivot axis 32 is located approximately $5\frac{1}{4}$ inches (13.3 cm) from swivel pad axis 46. Three ton rated models of clamp 10 weigh approximately 32 pounds (70.4 kg), and are designed to work with flanged beams whose flanges are up to $1\frac{1}{4}$ inches (3.2 cm) thick and between $5\frac{1}{4}$ to 9 inches (13.3–22.9 cm) wide. A one ton rated model is of course somewhat smaller, weighing about ten pounds (22 kg). One ton rated models of clamp 10 will work with flanged beams having a flange width between $3\frac{3}{4}$ to 8 inches (9.5–20.3 cm) and up to 1 inch (2.5 cm) thick. The distances between the shackle pivot axis 32 and the swivel pad axis 46 is reduced to about $4\frac{1}{4}$ inches (10.8 cm) and the swivel pad axis 46 is about $1\frac{1}{8}$ inches (2.9 cm) from the point of intersection of the planes of the engaging surfaces. Other dimensions of the one ton model of clamp 10 are likewise reduced.

It should be understood that various modifications, changes and, variations may be made in the arrangement, operation and details of construction of the elements disclosed herein, without departing from the spirit and scope of this invention.

What is claimed is:

1. A clamp for engaging a workpiece to be lifted comprising:

a rigid body defining a slot for receiving a workpiece;

a settable jaw attached to said body having its position with respect to said body adjustable along a line transverse to a longitudinal portion of the workpiece received in the slot of said body so as to be settable within a range of positions;

a swivel pad including a swivel pivot means for pivotally connecting said swivel pad and said rigid body;

a shackle for providing an attachment to a lifting means including a shackle pivot means for pivotally connecting said shackle and said swivel pad, said shackle pivot means having a shackle pivot axis about which said shackle and said swivel pad rotate with respect to each other, said shackle pivot means allowing the center of gravity of a suspended workpiece to align itself with a vertical plane extending through said shackle pivot axis;

a base face formed on said swivel pad for engaging the workpiece in a plane of engagement;

a hypotenusal face formed on said swivel pad for alternately engaging the workpiece in a plane of engagement which intersects the plane of engagement of said swivel pad, the angular relationship between each of the engaging planes and said shackle pivotal axis being such that when one of said faces is selected for engaging the freestanding workpiece, a plane through said shackle pivot axis and the center of gravity of the workpiece will pass through the base of the workpiece so that the workpiece may be lowered to rest on its original base and in its original orientation, and being such that when the other of said faces is selected for engaging the freestanding workpiece a plane through said shackle pivot axis and the center of gravity of the workpiece will not pass through the base of the workpiece so that the workpiece may be lowered to rest on a new base and in a new orientation.

2. A clamp as set forth in claim 1 wherein when said base face engages a flanged workpiece, said shackle pivot axis will nearly lie in a plane passing through the workpiece's center of gravity and orthogonal to the engaged flange.

3. A clamp as set forth in claim 1 wherein when said hypotenusal face engages a plate, said shackle pivot axis will nearly lie in a plane passing through the plate's center of gravity and parallel to the greater surface of the plate.

4. A clamp as set forth in claim 1 wherein each engaging face on said swivel pad is generally planar.

5. A clamp as set forth in claim 1 wherein:

said rigid body includes first and second arms defining a slot therebetween;

said settable jaw has a screw portion engaging a threaded hole contained in said first arm and having a convex cam located at an extremity of the axis of the screw portion, said cam being located between said first and second arms, and being connected to said screw portion by an articulation means; and said swivel pivot means has a swivel pad axis located near a line bisecting the angle of intersection between the planes of engagement of the faces on said swivel pad at a point which causes each face to sightly protrude into the slot between the first and second arms.

6. A clamp for engaging a workpiece to be lifted comprising:

a first plate having a first arm portion and a second arm portion;

a screw block affixed to the first arm portion of said first plate;

a second plate shaped substantially like said first plate and maintained in spaced parallel relation therefrom by the first arm portion of said second plate being affixed to said screw block;

a settable jaw having a screw portion threaded through said screw block, and having a rounded surface located at an extremity of the axis of the screw portion, the rounded surface located between the first and second arm portions of said first and second plates, and connected by an articulation to the screw portion;

a swivel pad including a swivel pivot means for pivotally connecting said swivel pad between the first arm portions of said first and second plates;

a shackle for providing an attachment to a lifting means including a shackle pivot means for pivotally connecting said shackle and said swivel pad, said shackle pivot means having a shackle pivot axis about which said shackle and said swivel pad rotate with respect to each other, said shackle pivot means allowing the center of gravity of a suspended workpiece to align itself with a vertical plane extending through said shackle pivot axis;

a base face formed on said swivel pad for engaging the workpiece in a plane of engagement;

a hypotenusal face formed on said swivel pad for alternately engaging the workpiece in a plane of engagement which intersects the plane of engagement of said swivel pad, the angular relationship between each of the engaging planes and the shackle pivotal axis being such that when one of said faces is selected for engaging the freestanding workpiece, a plane through said shackle pivot axis and the center of gravity of the workpiece will pass through the base of the workpiece so that the workpiece may be lowered to rest on its original base and in its original orientation, and being such that when the other of said faces is selected for engaging the freestanding workpiece a plane through said shackle pivot axis and the center of gravity of the workpiece will not pass through the base of the workpiece so that the workpiece may be lowered to rest on a new base and in a new orientation.

7. A clamp as set forth in claim 6, wherein:

said swivel pad has a nearly a right triangular shape; and said shackle pivotal axis is located near the apex of said swivel pad and is received between said first and second plates when said hypotenusal face is selected to engage the workpiece.

8. A clamp as set forth in claim 7 wherein each engaging face on said swivel pad is generally planar.

9. A clamp as set forth in claim 8 wherein said swivel pivot means has a swivel pad axis located near a line bisecting the angle of intersection between the planes of engagement of the engaging surfaces on said swivel pad at a point which causes each face to slightly protrude beyond the second arm portion of each of said first and second plates towards said settable jaw.

* * * * *